US010507688B2

(12) United States Patent
Zhang et al.

(10) Patent No.: US 10,507,688 B2
(45) Date of Patent: Dec. 17, 2019

(54) METAL SHEET PREPARING PROCESS WITH SURFACE HAVING WOOD GRAIN AND PRODUCT THEREOF

(71) Applicant: Zhejiang Yotrio Group Co., Ltd., Linhai (CN)

(72) Inventors: Guo Zhang, Linhai (CN); Jianping Xie, Linhai (CN)

(73) Assignee: ZHEJIANG YOTRIO GROUP CO., LTD., Linhai (CN)

( * ) Notice: Subject to any disclaimer, the term of this patent is extended or adjusted under 35 U.S.C. 154(b) by 0 days.

(21) Appl. No.: 15/965,867

(22) Filed: Apr. 28, 2018

(65) Prior Publication Data

US 2018/0311998 A1 Nov. 1, 2018

(30) Foreign Application Priority Data

Apr. 28, 2017 (CN) ..... 2017 1 0298530

(51) Int. Cl.

| | |
|---|---|
| ***B44C 1/22*** | (2006.01) |
| ***C23F 1/02*** | (2006.01) |
| ***B44F 9/02*** | (2006.01) |
| ***C23F 1/28*** | (2006.01) |
| ***C23F 1/20*** | (2006.01) |
| ***C23F 1/14*** | (2006.01) |

(52) U.S. Cl.

CPC ..... *B44C 1/227* (2013.01); *B44F 9/02* (2013.01); *C23F 1/02* (2013.01); *C23F 1/14* (2013.01); *C23F 1/20* (2013.01); *C23F 1/28* (2013.01)

(58) Field of Classification Search

None

See application file for complete search history.

(56) References Cited

U.S. PATENT DOCUMENTS

2004/0206029 A1* 10/2004 Luetgert ..... B29C 33/424 52/313
2008/0213616 A1* 9/2008 Luetgert ..... E06B 3/7001 428/601
2014/0083049 A1* 3/2014 Ruggie ..... B29C 33/00 52/784.1

* cited by examiner

*Primary Examiner* — Shamim Ahmed

(74) *Attorney, Agent, or Firm* — Schwegman Lundberg & Woessner, P.A.

(57) ABSTRACT

This invention provides a metal sheet preparing process with a surface having wood grain, and the process includes the following steps: spraying photosensitive ink on the metal sheet; pasting a designed film on a surface of the metal sheet sprayed with the photosensitive ink; exposing the metal sheet pasted with the film in an ultraviolet light for 1-15 min; spray developing the surface of the metal sheet with sodium carbonate solution, and exiting the film after developing; etching the metal sheet exited the film after developing with a mixed aqueous solution of ferric trichloride and copper sulfate, and a corrosive temperature being 30-50° C. which lasts for 5-8 min; and washing corrosive liquid on the grain and cured films of the photosensitive ink out of the grain with sodium hydroxide solution of 5-8% wt %.

2 Claims, 1 Drawing Sheet

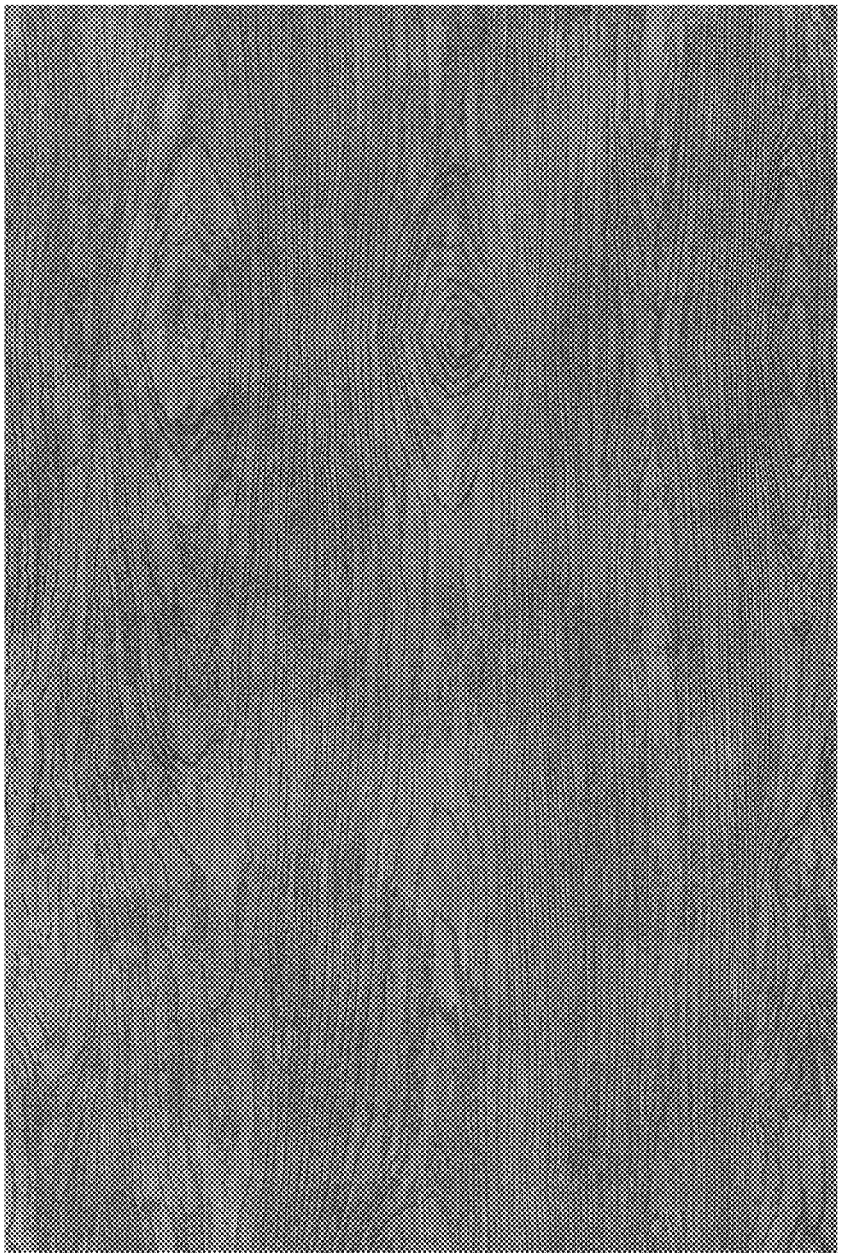

METAL SHEET PREPARING PROCESS WITH SURFACE HAVING WOOD GRAIN AND PRODUCT THEREOF

CROSS-REFERENCE TO RELATED APPLICATIONS

This Non-provisional application claims priority under 35 U.S.C. § 119(a) on Patent Application No(s). 201710298530.2 filed in People's Republic of China on Apr. 28, 2017, the entire contents of which are hereby incorporated by reference.

BACKGROUND OF THE INVENTION

Field of the Invention

This invention relates to a metal sheet preparing process with surface having wood grain and product, thereof which belong to a field of metal sheet processing.

Description of the Related Art

Wood products are expensive. Processing technology for wood products is complex, and treatment process for termite proofing or damp proofing wastes time and energy. Therefore, polyester imitation batten appears on the market, and mainly disadvantages are as following: the polyester imitation batten has certain deformation risks under high temperature exposure outdoors, which limits a kind number of the grain, thus the kind number of the grain is small, bumpy texture is weak, and cost performance and market competitiveness of the product are vastly reduced. An alternative solution is to use a metal sheet to etch, and a laser etching is currently used. The accuracy thereof is high, but it has disadvantages of high production cost and requiring expensive equipment; if a strong acid corrosive solution is used, pollution will be serous and post-processing will be complex. Production costs are increased in disguise, protection requirement for personnel is high during the productive process, corrosion accuracy is low, and corrosion speed is slow.

SUMMARY OF THE INVENTION

The purpose of the invention is to provide a metal sheet with surface having wood grain, to solve the problems that the polyester imitation batten has few kind number of lines, weak bumpy texture, low cost performance and bad market competitiveness in the prior art.

To solve the technical problem above, this invention also provides a metal sheet preparing process with surface having wood grain, which includes the following steps:

spraying photosensitive ink on the metal sheet;

pasting a designed film on a surface of the metal sheet sprayed with the photosensitive ink;

exposing the metal sheet pasted with the film in an ultraviolet light for 1-15 min;

spray developing the surface of the metal sheet with sodium carbonate solution, and exiting the film after developing;

etching the metal sheet exited the film after developing with a mixed aqueous solution of ferric trichloride and copper sulfate, and a corrosive temperature being 30-50° C. which lasts for 5-8 min; and washing corrosive liquid on the grain and cured films of the photosensitive ink out of the grain with sodium hydroxide solution of 5-8% wt %.

Optionally, the film may be manufactured according to the wood grain needed to be made.

Optionally, the metal sheet preparing process with surface having wood grain may further include a preparation step before the photosensitive ink is sprayed on the metal sheet, and the preparation step may be: washing the metal sheet with the sodium hydroxide solution after cutting, sanding and polishing.

Optionally, the weight percentage concentration of the sodium hydroxide solution may be 5-8%.

Optionally, a mole ratio of the ferric trichloride and the copper sulfate in the mixed aqueous solution of ferric trichloride and copper sulfate may be 1:(3-4).

The invention further provides a metal sheet with surface having wood grain, wherein the metal sheet uses the above-mentioned metal sheet preparing process with surface having wood grain.

Optionally, the metal sheet may be one of an iron sheet, a stainless steel sheet and an aluminium sheet.

The metal sheet preparing process with surface having wood grain has the following advantages:

1. The metal sheet preparing process with surface having wood grain in the invention rises the corrosion temperature, exits the film and etches with mixed aqueous solution of ferric trichloride and copper sulfate. The corrosivity of the etchant solution is small, the pollution is low, the corrosion speed is high, the corrosion width and depth are large, the gradient between the corrosion region and non corrosion region is large, and the pattern accuracy is high; the manufactured grain is realistic, clear and obvious with no circulation in the grain, and the bumpy texture is under control; and the developing staining only needs staining once, which greatly saves costs, thus the costs are cheap.

2. The sodium hydroxide solution of 5-8% wt % in the invention can effectively remove the oil stain and other impurity powder on the surface of the metal sheet.

3. The metal sheet with surface having wood grain in the invention can be applied in a table surface, a table leg, an armrest surface, a decorative sheet and so on. It has advantages of diversified grain, strong bumpy texture and so on, and the cost performance and the market competitiveness of the product are vastly improved.

BRIEF DESCRIPTION OF THE DRAWINGS

FIG. 1 is a schematic diagram of a finished product of a metal sheet with a surface having wood grain in this invention.

DETAILED DESCRIPTION OF THE INVENTION

In view of the FIGURE, the technical solution of the invention is described with embodiments sufficiently clear and complete. The embodiments below are to illustrate the invention, but not to limit the range of the invention.

This invention provides a metal sheet preparing process with a surface having wood grain, and the process includes the following steps:

spraying photosensitive ink on the metal sheet;

pasting a designed film on the surface of the metal sheet sprayed with the photosensitive ink;

exposing the metal sheet pasted with the film in an ultraviolet light for 1-15 min;

spray developing the surface of the metal sheet with sodium carbonate solution, and exiting the film after developing; and etching the metal sheet exited the film after developing with a mixed aqueous solution of ferric trichloride and copper sulfate, and a corrosive temperature being 30-50° C. which lasts for 5-8 min; and washing corrosive liquid on the grain and cured films of the photosensitive ink out of the grain with sodium hydroxide solution of 5-8% wt %.

The film is manufactured according to the wood grain needed to be made.

The metal sheet preparing process with the surface having wood grain further includes a preparation step before the photosensitive ink is sprayed on the metal sheet, and the preparation step is: washing the metal sheet with the sodium hydroxide solution after cutting, sanding and polishing.

The weight percentage concentration of the sodium hydroxide solution is 5-8%.

The mole ratio of the ferric trichloride and the copper sulfate in the mixed aqueous solution of ferric trichloride and copper sulfate is 1:(3-4).

It's important to note that, a concentration of the developing sodium carbonate is 1%, after washing, the metal sheet can be baked and cured after being dried, the baking and curing temperature is 140° C. and the duration is 20 minutes.

It's important to note that this invention can also be applied in other patterns similar to the wood grain.

It's important to note that lamp source of the ultraviolet light in the invention can be an ultraviolet lamp or a mercury lamp.

It's important to note that after exposing the metal with the photosensitive ink on its surface in the ultraviolet light, the surface of the metal sheet is spray developed with the sodium carbonate solution. During exposure, the photosensitive ink in a light radiation region reacts and forms a cover layer on the surface of the metal which has a good adhesion with metals such as aluminum and iron; during development, as the photosensitive ink in an unirradiated region has a bad adhesive force with the metal, it is washed away by the sodium carbonate solution, wherein the photosensitive ink mainly protects areas that don't need corrosion.

In the embodiments above, the model of the photosensitive ink can be XR-9009 ink produced by Shenzhen Summer Electronics Corporation, and the film can be a film with wood grain designed on it after buying commercially.

As shown in FIG. 1, this invention also provides a metal sheet with a surface having wood grain, and the metal sheet adopts the above-mentioned metal sheet preparing process with the surface having the wood grain.

The metal sheet is one of an iron sheet, a stainless steel sheet and an aluminium sheet.

Two embodiments are provided to explain in detail.

Embodiment 1

A metal sheet preparing process with a surface having wood grain includes the following steps:

(1) washing an iron sheet with sodium hydroxide solution with a weight percentage concentration of 5% after cutting, sanding and polishing;

(2) spraying photosensitive ink on the metal sheet;

(3) pasting a designed film on the surface of the metal sheet sprayed with the photosensitive ink;

(4) exposing the metal sheet pasted with the film in an ultraviolet light for 1 minute;

(5) spray developing the surface of the metal sheet with sodium carbonate solution, and exiting the film after developing;

(6) etching the iron sheet exited the film after developing with a mixed aqueous solution of ferric trichloride and copper sulfate, wherein a mole ratio of the ferric trichloride and the copper sulfate is 1:3, and a corrosive temperature is 30° C. which lasts for 5 minutes; and (7) washing corrosive liquid on the grain and cured films of the photosensitive ink out of the grain with sodium hydroxide solution of 5% wt %.

Embodiment 2

A metal sheet preparing process with a surface having wood grain includes the following steps:

(1) washing an aluminum sheet with sodium hydroxide solution with a weight percentage concentration of 8% after cutting, sanding and polishing with the sodium hydroxide solution;

(2) spraying photosensitive ink on the metal sheet;

(3) pasting a designed film on the surface of the metal sheet sprayed with the photosensitive ink;

(4) exposing the metal sheet pasted with the film in an ultraviolet light for 15 minute;

(5) spray-developing the surface of the metal sheet with sodium carbonate solution, and exiting the film after developing;

(6) etching the aluminum sheet exited the film after developing with a mixed aqueous solution of ferric trichloride and copper sulfate, wherein a mole ratio of the ferric trichloride and the copper sulfate is 1:4, and a corrosive temperature is 50° C. which lasts for 8 minutes; and (7) washing corrosive liquid on the grain and cured films of the photosensitive ink out of the grain with sodium hydroxide solution of 8%.

| testing item | corrosion speed (mm/min) | corrosion depth (mm) | gradient between corrosion region and non corrosion region (° ) | maximum corrosion width (mm) | pattern accuracy of embossment when bump of metal sheet is 0.5-2 mm (Dpi) |
|---|---|---|---|---|---|
| Embodiment 1 | 0.06 | 0.5 | 75 | 15 | 400 |
| Embodiment 2 | 0.08 | 1 | 85 | 20 | 600 |
| Comparative Example 1 | 0.005 | 0.02 | 45 | 1 | 50 |
| Comparative Example 2 | 0.01 | 0.4 | 60 | 8 | 200 |
| Comparative Example 3 | 0.09 | 0.3 | 45 | 12 | 150 |

The film is not exited in Comparative Example 1 during processing, and a mixed solution of ferric trichloride and hydrochloric acid or phosphoric acid is used.

Comparative Example 2

The metal sheet is exposed in ultraviolet light for 30 seconds, and the metal sheet exited the film after developing is etched with a mixed aqueous solution of ferric trichloride and copper sulfate, wherein the mole ratio of the ferric trichloride and the copper sulfate is 1:5, and the corrosive temperature is 20° C. which lasts for 4 minutes.

Comparative Example 3

The metal sheet is exposed in ultraviolet light for 20 minutes, and the metal sheet exited the film after developing is etched with a mixed aqueous solution of ferric trichloride and copper sulfate, wherein the mole ratio of the ferric trichloride and the copper sulfate is 1:1, and the corrosive temperature is 60° C. which lasts for 10 minutes.

In conclusion, the invention exits the film and etches with a mixed aqueous solution of ferric trichloride and copper sulfate. The corrosivity of the etchant solution is small (without strong acid such as hydrochloric acid and phosphoric acid), the pollution is low, the etching time is short with 5-8 min, the corrosion speed is high (achieving 0.06-0.08 mm/min in Embodiment 1 and Embodiment and 2, the maximum corrosion width is 15-20 mm and the corrosion depth is more than 0.5 mm, gradient between the corrosion region and non corrosion region is more than 75°, and the pattern accuracy of the embossment when the bump of the metal sheet is 0.5-2 mm is more than 400 Dpi. It is especially suitable for manufacturing the metal sheet with the wood grain in large areas; it can be applied in a table surface, a table leg, an armrest surface, a decorative sheet and so on, it has advantages of diversified grain and strong bumpy texture and so on, and the cost performance and the market competitiveness of the product are vastly improved. The technique of this invention is simple, with no requirement of large or complex devices. In Comparative Example 1 (prior art), the corrosion speed is far smaller than those in Embodiment 1 and Embodiment 2, the pattern accuracy of the embossment when the bump of the metal sheet (Dpi) is 0.5-2 mm is only 50 Dpi, the gradient between the corrosion region and non corrosion region is only 45°, and the corrosion depth is small, thus the third dimension of the embossment is weak, it is not suitable for wood grain carving in large areas. Comparative Example 2 is below the most appropriate process range, the corrosion speed in Comparative Example 2 is small, the corrosion gradient is 60° which is also relatively small; and the pattern accuracy of the embossment when the bump of the metal sheet (Dpi) is 0.5-2 mm is only 200 Dpi, while Comparative Example 3 is above the most appropriate process range, which reduces the gradient between the corrosion region and non corrosion region. Specifically, the protecting areas of part of the photosensitive ink is corroded, and the pattern accuracy of the embossment when the bump of the metal sheet (Dpi) is 0.5-2 mm is only 150 Dpi, which is even lower. In the process range regulated above, it has a better corrosion effect.

Although the invention is described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A metal sheet with a surface having wood grain, wherein the metal sheet is manufactured by a metal sheet preparing process with surface having wood grain, the process comprising the following steps:

spraying photosensitive ink on the metal sheet;

pasting a designed film on a surface of the metal sheet sprayed with the photosensitive ink;

exposing the metal sheet pasted with the film in an ultraviolet light for 1-15 min;

spray developing the surface of the metal sheet with sodium carbonate solution, and exiting the film after developing; and etching the metal sheet exited the film after developing with a mixed aqueous solution of ferric trichloride and copper sulfate, wherein a corrosive temperature is 30-50° C. which lasts for 5-8 min; and washing corrosive liquid on the grain and cured films of the photosensitive ink out of the grain with sodium hydroxide solution of 5-8% wt %, wherein the surface having wood grain comprises the designed film and photosensitive ink; wherein the photosensitive ink is closer to the metal sheet than the designed film; wherein a maximum corrosion width is 15-20 mm, a corrosion depth is more than 0.5 mm, a gradient between a corrosion region and a non-corrosion region is more than 75°; and a pattern accuracy of the embossment when a bump of the metal sheet is 0.5-2 mm is more than 400 Dpi.

2. The metal sheet with the surface having the wood grain according to claim 1, wherein the metal sheet is one of an iron sheet, a stainless steel sheet and an aluminum sheet.

* * * * *